US005145404A

United States Patent [19]

Beattie et al.

[11] Patent Number: 5,145,404

[45] Date of Patent: Sep. 8, 1992

[54] SWITCH TERMINAL BOARD COVER WITH ELECTRICAL LEAD ISOLATION

[75] Inventors: Glen H. Beattie; Dale R. Jesselson, both of Livonia, Mich.

[73] Assignee: United Technologies Automotive, Inc., Dearborn, Mich.

[21] Appl. No.: 746,169

[22] Filed: Aug. 14, 1991

Related U.S. Application Data

[63] Continuation of Ser. No. 591,314, Oct. 1, 1990, abandoned.

[51] Int. Cl.[5] ..... H01R 13/52

[52] U.S. Cl. ..... 439/521; 439/718; 439/719; 439/892; 439/465

[58] Field of Search ..... 439/519, 521, 718, 719, 439/34, 449, 456, 457, 458, 460, 461, 463, 465, 892, 893, 713, 731, 516

[56] References Cited

U.S. PATENT DOCUMENTS

| | | | |
|---|---|---|---|
| 3,041,504 | 6/1962 | Lacan | 439/892 X |
| 3,112,148 | 11/1963 | Wochner | 439/521 |
| 3,167,375 | 1/1965 | Sarazen | 439/449 X |
| 3,836,699 | 9/1974 | Downing | 439/731 X |
| 4,029,896 | 6/1977 | Skinner | 439/457 X |
| 4,153,326 | 5/1979 | Frantz et al. | 439/465 X |
| 4,749,370 | 6/1988 | Moser et al. | 439/460 |
| 4,795,857 | 1/1989 | McInnis | 439/521 X |
| 5,057,650 | 10/1991 | Urushibata et al. | 439/465 X |

*Primary Examiner*—Larry I. Schwartz
*Assistant Examiner*—J. R. Daulton
*Attorney, Agent, or Firm*—Randy G. Henley

[57] ABSTRACT

A switch terminal board cover 20 (FIG. 2) is molded from a non-conductive material and consists of a base 21, a spacing edge 22 with retaining latches 24,25 and an opening 23, and a plurality of projections 26 disposed on the base. The projections 26 are sized and positioned such that they form a plurality of slots which prevent excessive movement of and contact between electrical leads 10, thereby preventing electrical shorts from occurring, and help maintain the integrity of electrical terminations 12 of a switch 11 (FIG. 3).

2 Claims, 1 Drawing Sheet fig. 1
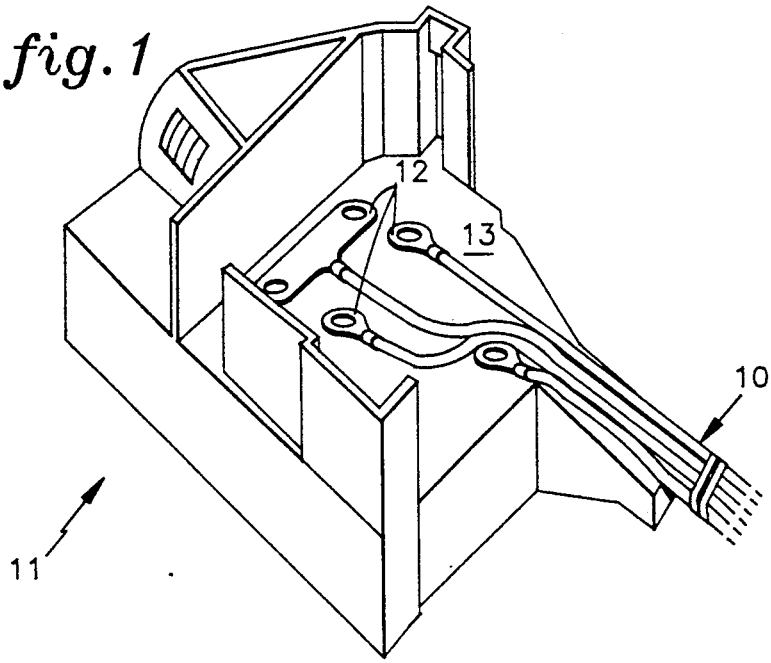
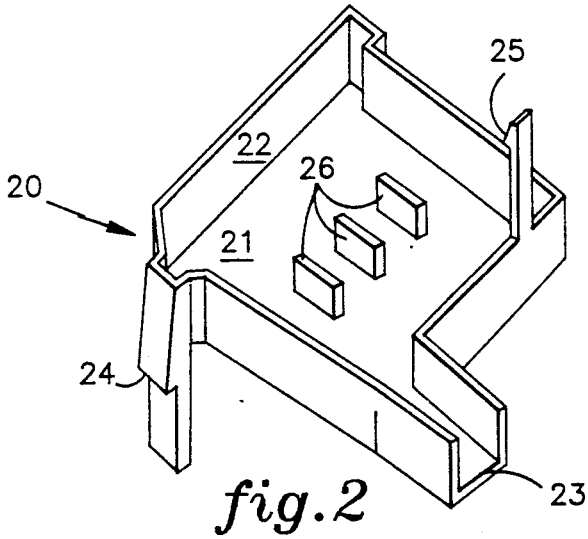
fig. 2
fig. 3
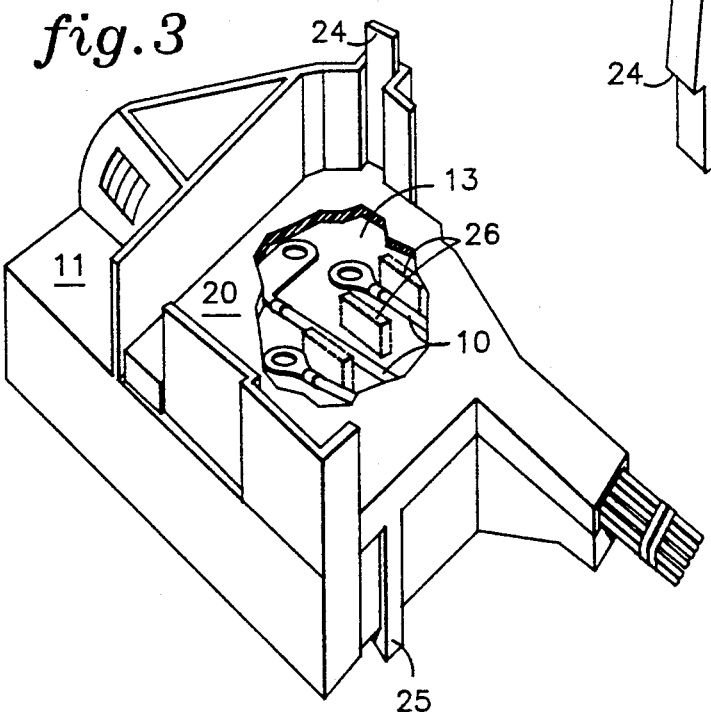

SWITCH TERMINAL BOARD COVER WITH ELECTRICAL LEAD ISOLATION

This application is a continuation of U.S. Pat. application Ser. No. 07/591,314, filed Oct. 1, 1990, now abandoned.

TECHNICAL FIELD

This invention relates to switch terminal board covers which isolate electrical leads, and more particularly to switch terminal board covers which prevent excessive movement of and contact between electrical leads.

BACKGROUND ART

It is known in the automobile industry that is convenient to have a single termination location for multiple electrical leads going to switches located on a steering column, such as the headlight dimmer and ignition switches. Electrical leads are pigtailed and then hardwired to a single terminal board located at the lower end of a steering column. Each lead is hardwired to a single point by use of a rivet type termination, which is preferred due to its cost effectiveness relative to other types of hardwired terminations. A drawback to this method of termination, however, is that over time terminals loosen and leads move around, pivoting at the terminals. This movement can allow contact between adjacent leads and cause electrical shorts. In addition, the movement reduces the integrity of the electrical connection of a terminal.

A current method of preventing short circuiting is to isolate leads by the use of shrink tubing. This method involves placing a sufficient amount of shrink tubing on each lead prior to connecting the lead to a terminal. Once the lead is riveted to a terminal heat is applied to the shrink tubing to seal it around the lead. When a terminal loosens and contact between leads occur, the shrink tubing provides isolation and prevents short circuiting. However, this method is expensive due to the time intensive process of applying shrink tubing and does not present movement of leads. Another possible solution is to mold isolating barriers onto a terminal board and thereby provide separation of leads. A terminal board would then be modified to apply to a particular switch rather than the universal applicability of the terminal boards which currently exists. This solution would increase inventory problems (having to stock and categorize a variety of terminal boards) and work handling problems (having to choose from a variety of terminal boards depending on the application). In addition, fabrication costs would increase due to having to adapt and reset the riveting mechanism depending on the type of terminal board being used to fabricate the switch.

DISCLOSURE OF INVENTION

Objects of the invention includes an improved method to isolate and prevent excessive movement of leads on switch terminal boards.

According to the invention, a plurality of leads are separated and constrained by non-conductive projections on a switch terminal board cover which form slots to provide isolation between leads and restrict the movement of leads. This invention avoids the costly application of shrink tubing or some other isolating material to leads and helps to maintain the integrity of the connection at a terminal. Placing isolating projections on a switch terminal board cover allows for ease of access to terminals during fabrication, repair and modification and maintains the adaptability of terminal boards. Although disclosed herein for use as a switch terminal board cover for a headlight dimmer/ignition switch of an automobile, the invention may be utilized in a variety of applications.

The foregoing and other objects, features and advantages of the present invention will become more apparent in the light of the following detailed description of exemplary embodiments thereof, as illustrated in the accompanying drawings.

BRIEF DESCRIPTION OF THE DRAWINGS

FIG. 1 is a perspective view of the automobile dimmer/ignition switch and terminal board.

FIG. 2 is a perspective view of the switch terminal board cover.

FIG. 3 is a partially broken away, perspective view of the automobile dimmer/ignition switch and terminal board with the switch terminal board cover in place.

BEST MODE FOR CARRYING OUT THE INVENTION

Referring now to FIG. 1 in an unassembled condition, a plurality of leads 10 extend longitudinally and are connected to a dimmer/ignition switch 11 by a corresponding plurality of terminations 12 which are hardwired by being riveted to appropriate positions on a terminal board 13. In FIG. 2, a switch terminal board cover 20 molded from a non-conductive material, such as nylon or delrin, consists of a base 21 shaped appropriately such that is extends longitudinally to cover the terminal board 13 of the dimmer/ignition switch 11 (FIG. 1), a spacing wall 22 around the edge of the base 21 which extends vertically 21, sized from the base to maintain a space between the terminal board 13 and the base 21, with an opening to allow for the passage of the leads 10, two retaining latches 24, 25, positioned appropriately to retain the switch terminal board cover 20 to the dimmer/ignition switch 11, and a plurality of electrical isolation projections 26. The projections 26, the number and location of which is governed by the number and location of the terminals 12 and leads 10 (FIG. 1) extend vertically and longitudinally from the base and are positioned such that they separate the leads 10 in close proximity to the terminal board 13.

Referring to FIG. 3, in an assembled condition the switch terminal board cover 20 fits over the terminal board 13 of the dimmer/ignition switch 11 and is secured into place by the retaining latches 24, 25. The separation of the terminal board 13 and the terminal board cover defines a cavity therebetween. The projections 26, which are spaced between the leads 10, are sized to make contact with the upper surface of the terminal board 13 to form a plurality of slots which the leads 10 are constrained within, thereby preventing excessive movement of and contact between the leads 10 and eliminating electrical shorts due to such contact.

Although the invention has been shown and described with respect to exemplary embodiments thereof, it should be understood by those skilled in the art that various changes, omissions and additions may be made therein and thereto, without departing from the spirit and scope of the invention.

We claim:

1. A switch of the type having a terminal board adapted to permit variability of electrical lead termination locations for variable switch applications, a terminal board cover which extends longitudinally and vertically in a direction perpendicular to the longitudinal direction, the terminal board cover adapted to extend over the terminal board and thereby define a cavity therebetween, and a plurality of electrical leads which longitudinally extend into the cavity in a longitudinal direction to a location at which each lead is independently hardwired to the terminal board, the hardwire locations being in communication, the terminal board cover including the base adapted to extend over the terminal board of the switch, the base extending in the longitudinal direction, a spacing wall around the edge of the base, which extends vertically from the base, and which has at least one opening to allow for passage of electrical leads, and means for attaching the terminal board cover to the switch, the electrical leads including exposed portions, the exposed portions having mobility which permits contact between the exposed portions in an unassembled condition of the switch, and wherein the improvement comprises:

a plurality of non-conductive projections extending vertically from the base, wherein in an assembled condition said projections extend vertically through the cavity and longitudinally between the openings and the hardwire locations to form a plurality of slots, said projections extending between exposed, adjacent electrical leads of the switch in close proximity to the terminal board, said projections not extending into the region defined by the hardwire locations thereby permitting variability in the hardwire locations, said projections adapted to prevent short circuits between the electrical leads by separating and isolating exposed portions which are disposed within adjacent slots and by restricting the motion of exposed portions extending between the slots and the hardwire locations to prevent contact between such adjacent portions.

2. The switch according to claim 1, wherein the spacing wall has only a single opening through which is passed the plurality of electrical leads, and wherein each projection is longitudinally parallel to the other projections.

* * * * *